United States Patent [19]

Herriman

[11] 4,456,154

[45] Jun. 26, 1984

[54] TONER LOADING CARTRIDGE

[75] Inventor: Leland Herriman, Walworth, N.Y.

[73] Assignee: Xerox Corporation, Stamford, Conn.

[21] Appl. No.: 408,407

[22] Filed: Aug. 16, 1982

[51] Int. Cl.³ ..... B65B 1/06

[52] U.S. Cl. ..... 222/325; 222/DIG. 1; 222/484; 222/559; 141/363

[58] Field of Search ..... 222/DIG. 1, 325, 478, 222/481, 483, 484, 537, 544, 559, 561, 565; 141/363–366, 237, 238, 240

[56] References Cited

U.S. PATENT DOCUMENTS

| | | | |
|---|---|---|---|
| 3,501,065 | 3/1970 | Altmann et al. | 222/392 |
| 3,915,208 | 10/1975 | Anderson | 141/363 |
| 4,089,601 | 5/1978 | Navone | 355/14 |
| 4,237,943 | 12/1980 | Ermel et al. | 141/364 X |

FOREIGN PATENT DOCUMENTS 2056320A 3/1979 United Kingdom .

*Primary Examiner*—Joseph J. Rolla
*Assistant Examiner*—Kevin P. Shaver

[57] ABSTRACT

A toner cartridge for replenishing toner in a reproducing machine which may be readily inserted in an opening in a toner dispenser, includes a base plate and a toner hopper slidably engaged with the top of the base plate, both the base plate and the toner hopper having a plurality of apertures therein for toner to pass therethrough into the toner dispenser when in the open position. The base plate of the toner cartridge has a hook at one end adapted to lock under the lip of the toner dispenser opening when the cartridge is inserted in it, and the toner hopper has a hole at the opposite end adapted to lock under the lip of the toner dispenser opening when the toner hopper is slidably moved from the closed position to the open position. In the closed position portions of the base plate provide a seal under the apertures in the toner hopper and when the toner hopper is slidably moved to the open position, the apertures in the base plate and toner hopper are open permitting toner to fall into the toner dispenser. A preferred toner hopper comprises a plurality of bins each with a plurality of inclined sides defining a chute which terminates in the plurality of apertures in the bottom of the toner hopper. With this structure the toner cartridge dispenses toner only when in the locked position and is removable from the dispenser only when in the closed position.

11 Claims, 5 Drawing Figures

TONER LOADING CARTRIDGE

BACKGROUND OF THE INVENTION

The present invention relates to a toner loading cartridge for replenishing toner in automatic reproducing machines. In particular, the present invention relates to a toner loading cartridge which can be used in a "White Glove" operation to replenish depleted toner in a toner dispenser. By the present invention, it is possible to replenish toner in automatic copying machines without contaminating either the interior or exterior of the machine, or the operator with loose toner powder.

In electrostatographic reproducing apparatus commonly in use today, a photoconductive insulating member is typically charged to uniform potential and thereafter exposed to a light image of an original document to be reproduced. The exposure discharges the photoconductive insulating surface in exposed background areas and creates an electrostatic latent image on the member which corresponds to the image areas contained within the usual document. Subsequently the electrostatic latent image on the photoconductive insulating layer is made visible by developing the latent image with developing powder referred to in the art as toner. Most development systems employ development material which comprises both charged carrier particles and charged toner particles which triboelectrically adhere to the carrier particles. During development, the toner particles are attracted from the carrier particles by the charged pattern of the image areas on the photoconductive insulating area to form a powder image on the photoconductor. This may subsequently be transferred to a support such as copy paper to which it may be permanently affixed by heating or by the application of pressure.

In the commercial electrostatographic machines available on the market today, the supply of toner in the developer mix must be periodically replenished to maintain copy quality. Typically this is through the use of a dispenser of the toner which contains a supply of toner. Periodically however, this supply of fresh toner in the toner dispenser must also be replenished. Initially this was accomplished merely by pouring loose toner from a toner container into the toner dispenser. This is a very untidy operation with toner being spilled on the interior and exterior of the machine as well as on the machine operator which can result in soiled and/or damaged clothing.

The loose toner is very light and fluffy and is carried by the smallest air current to all parts of the machine. Externally of the machine in addition to protential soiling of the operator personally and his/her clothing, the toner can collect on machine covers, stands, carpets, walls, and furniture surfaces.

The toner which is loose within the machine creates even more serious problems. The air currents take the toner and spread it throughout the entire machine. The toner can contaminate any charging corotrons resulting in non-uniform charging and therefore non-uniform formation of developed images. In addition, loose toner within the machine may contaminate sheet feed rolls particularly in the copy sheet feeder leading to skewed sheet feeding, paper jams, and machine shut down. In addition, toner floating in the air within the machine may deposit on the copy sheet before it enters the fuser and show up on the final copy as very small, fused black spots thereby substantially increasing background and reducing overall copy quality.

Altogether toner contamination from the above causes as well as others is a major cause of machine shut down and thereby a service call by a skilled technician to correct the problem. However, once the loose toner gets into the machine, it is very difficult, if not impossible, at times to clean the copier. The best method so far developed has been with the use of a vacuum cleaner which the service technician has to carry for such a purpose.

There has therefore been a long desire for a clean dry process to replenish toner without creating the above noted problems. There has been a long desire to provide a toner cartridge which can replenish toner in the copying machine without contaminating the interior and exterior of the machine or the machine operator. A number of approaches have been tried most of which require that the toner replenishing cartridge be left in the machine during machine usage. This approach has typically suffered from the fact that a gap between the toner reservoir and the cartridge do is indeed exist and toner will then escape into the machine.

PRIOR ART

U.S. Pat. No. 3,501,065 (Altmann et al.) illustrates a toner container and dispenser mechanism wherein toner is extracted from an outer cover and automatically placed in the toner reservoir. The toner container has a top supportable slot and a windable web which defines the toner carrying capacity of the container. As the web is wound it is raised and the toner carrying capacity is decreased forcing toner out of the top of the container into the toner reservoir.

U.S. Pat. No. 3,915,208 (Anderson) describes a toner supply apparatus with a replenishing container. The new toner is introduced to the reservoir by means of a sealed container which can be opened only after installation in a cooperative receptacle in the reservoir. The toner container includes an outlet spout cooperative with an associated inlet receptacle in the toner reservoir, the spout being movable to an open position only after insertion in and retention by the receptacle. The container cannot be readily removed from the toner reservoir without closure of the outlet spout.

U.S. Pat. No. 4,089,601 (Navone) describes a disposable toner cartridge for copying machines which comprises a first outer container having an opening at the bottom and a second inner container inside the first container having a second opening and being movable with respect to the first container from a position of containment of the toner to a position for discharge of the toner in which the first and second openings are aligned. A grip is used to rotate the inner container relative to the outer container locking the container in the open position so that they may not be reused.

U.K. Patent Application No. 2,056,320 (Van Soest et al.) illustrates a toner container which includes an oblong opening covered by a membrane and a movable knife edge which is moved longitudinally from a closed position to an open position cutting the membrane in the process.

SUMMARY OF THE INVENTION

In accordance with the present invention, a toner cartridge for replenishing toner in a toner dispenser is provided. The cartridge which may be inserted in an opening in a toner dispenser is part of a "White Glove"

toner replenishment operation. The cartridge includes a base plate and a toner hopper slidably engaged with the top of the base plate, both the base plate and the toner hopper having a plurality of apertures therein for toner to pass therethrough into the toner dispenser when the toner hopper and the base plate are in the open position. The base plate of the toner cartridge hasa hook at one end which upon insertion in the top opening of the toner dispenser is adapted to lock under the lip of the toner dispenser opening. The toner hopper has a hook at the opposite end of the toner cartridge which after the hook on the base plate is in place under the lip of the toner reservoir may be lowered into the opening in the toner dispenser and the toner hopper slidably moved relative to the base plate to position the hook on the toner cover in loading position under the lip of the toner dispenser opening. In the closed position portions of the base plate provide a seal under the apertures in the toner hopper and prevent toner from escaping from the toner cartridge. When the toner hopper is slidably moved to the open position, the apertures in the base plate and toner hopper are open permitting toner to fall into the toner dispenser.

A specific aspect of the toner hopper comprises a plurality of bins each with a plurality of inclined sides defining a chute which terminates in a plurality of apertures in the bottom of the toner hopper. In a specific aspect of this configuration are four equally shaped side portions, each inclined at an angle of from about 35° to about 55° to the plane of the base plate. In a preferred aspect of this configuration, the side portion are each inclined at an angle of about 45° to the plane of the base plate.

In a further aspect of the present invention, the toner cartridge including both the base plate and the toner hopper are rectangular in shape and wherein the apertures in the toner hopper and the base plate are positioned such that they are in communicating alignment when in the opened or dispensing position and that portions of the base plate between the apertures in the base plate are in sealing engagement with the apertures in the toner hopper when the base plate and the toner hopper are in the closed position.

In an additional aspect of the present invention, means are provided to slidably move the toner hopper relative to the base plate comprising a pair of parallel tracks on opposite sides of the plurality of apertures in the hopper in sliding engagement with a plurality of hooks arranged in parallel rows on opposite sides of said apertures in said base plate.

Accordingly, it is an object of the present invention to provide a novel toner cartridge.

It is a further object of the present invention to provide a toner cartridge for replenishing toner in a copying machine without contaminating either the interior or exteriof of the machine or the operator with loose toner powder.

It is a further object of the present invention to provide a relatively inexpensive, disposable toner replenishing cartridge.

It is an additional object of the present invention to provide a toner cartridge which cannot be opened unless it is properly inserted in the toner reservoir.

It is a further object of the present invention to provide a toner cartridge which once in the machine and emptied, cannot be removed from the machine until the toner opening has been closed.

For a better understanding of the present invention as well as other objects and further features thereof reference is had to the following drawings and description.

DESCRIPTION OF THE PREFERRED EMBODIMENT

The invention will now be described with reference to a preferred embodiment of the reproducing apparatus sheet delivery means.

Figure 1:
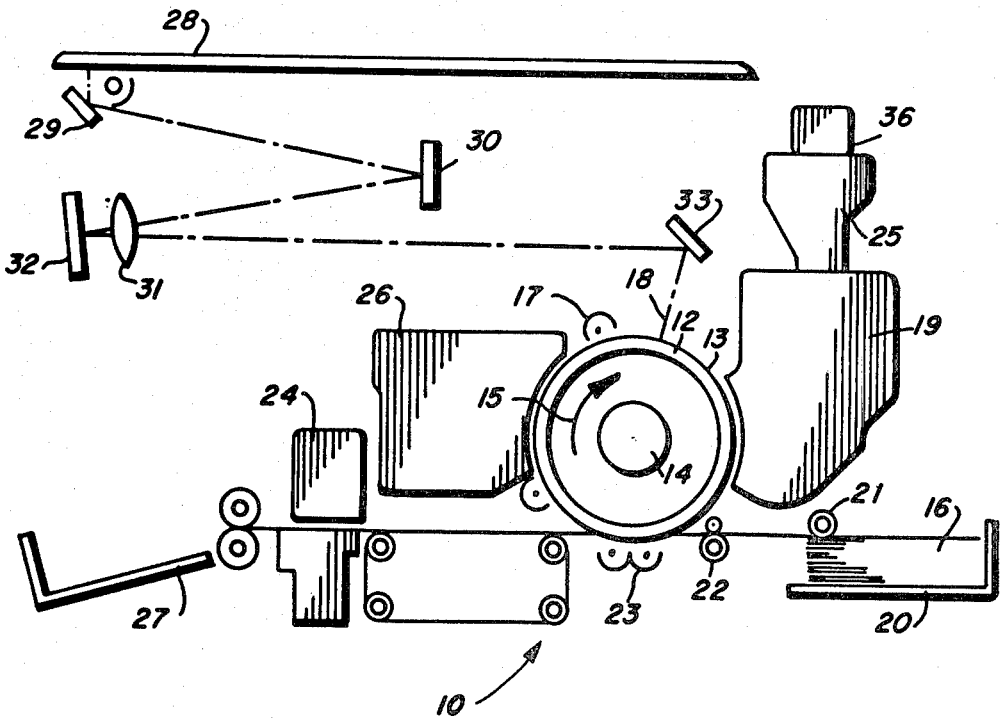
FIG. 1 is a schematic representation in cross section of the operational elements of an automatic reproducing apparatus that would be replenished with toner from the toner cartridge of the present invention.
Figure 2:
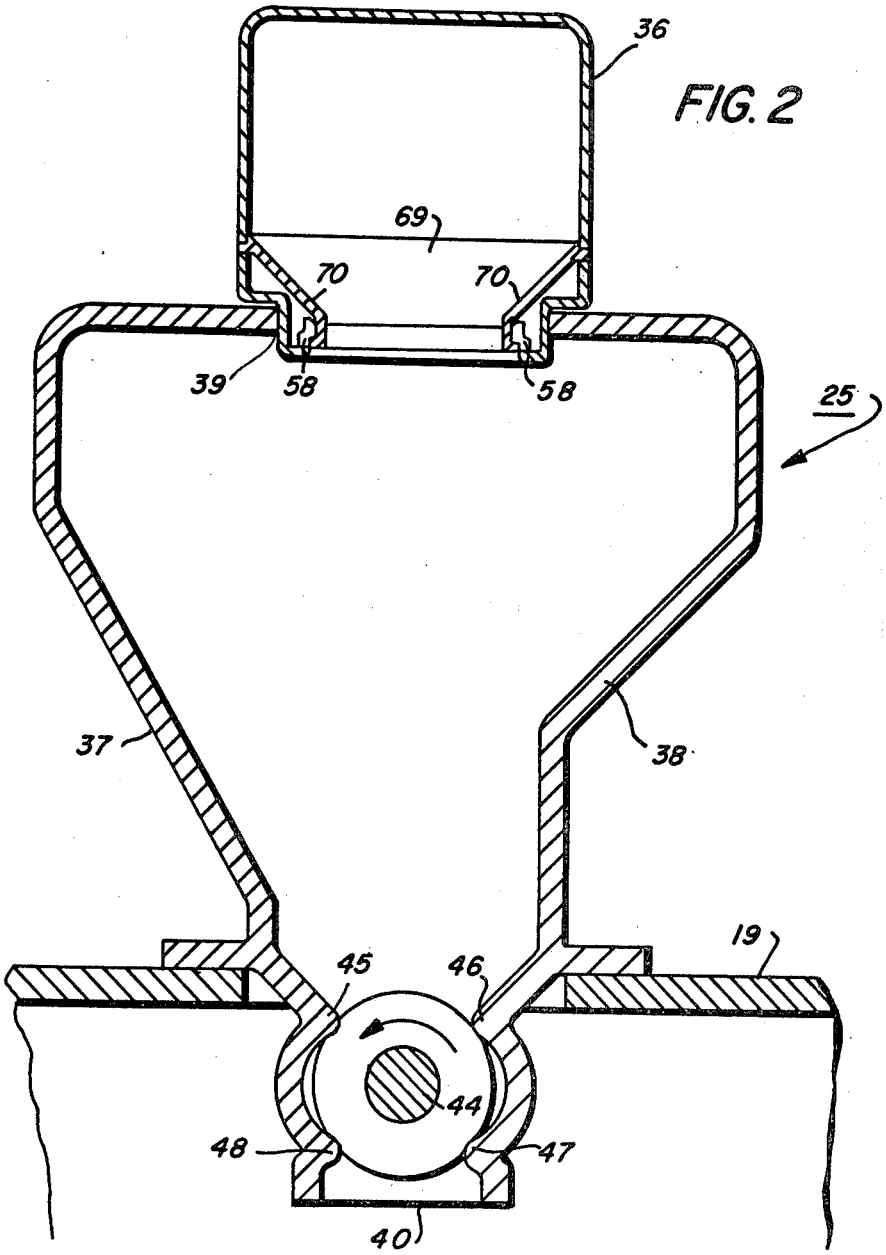
FIG. 2 is an enlarged representation in cross section of the toner dispenser illustrated in FIG. 1 with the replenishing toner cartridge of the present invention in the replenishing position.
Figure 3:
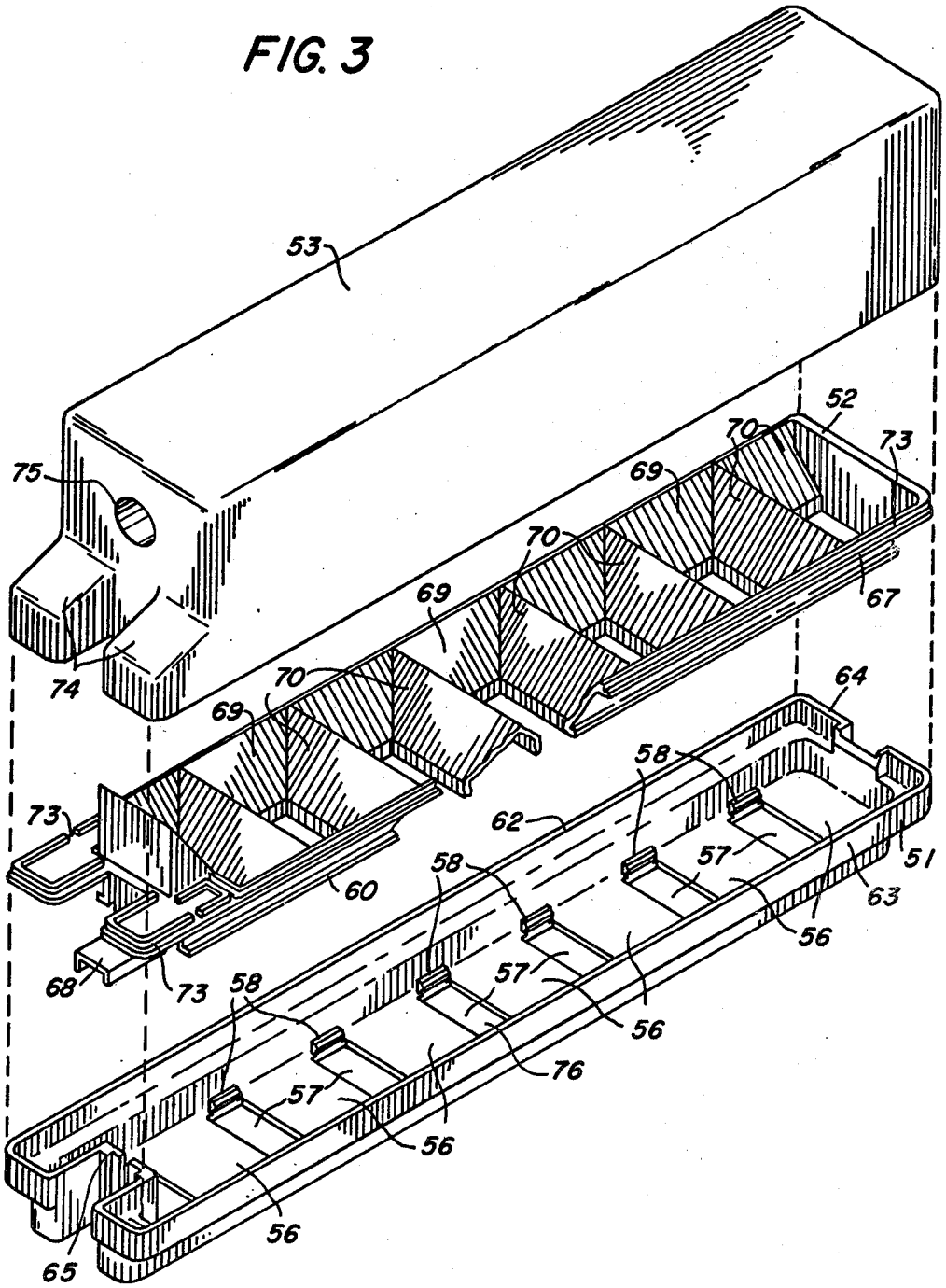
FIG. 3 is an exploded isometric view of the toner cartridge of the present invention.

Referring now to FIG. 1 there is shown by way of example an automatic xerographic reproducing machine 10 which includes the sheet delivery apparatus of the present invention. The reproducing machine 10 depicted in FIG. 1 illustrates the various components utilized therein for producing copies from an original. Although the toner cartridge of the present invention are particularly well adapted for use in an automatic xerographic reproducing machine 10, it should become evident from the following description that they are equally well suited for use in a wide variety of processing systems including other electrostatographic systems and they are not necessarily limited in their application to the particular embodiment or embodiments shown herein.

The reproducing machine 10 illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17. In the charging station 17 an electrostatic charge is uniformly placed over the photoconductive surface 13 preparatory to imaging.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of an electrostatic latent image. In the embodiment illustrated, a document to be reproduced is placed on the imaging platen 28 and scanned by a system of scanning mirrors 29, 30 and lens 31, mirrors 32 and 33 to produce an image on the drum 12. After exposure drum 12 rotates the electrostatic latent image recorded on the photoconductive surface 13 to development station 19 wherein a conventional developer mix is applied to the photoconductive surface 13 of the drum 12 rendering the latent image visible. Typically the development station comprises a magnetic brush development system utilizing a magnetizable developer mix having coarse ferromagnetic carrier granules and colored toner particles. The developer mix is brought through a directional flux field to form a brush thereof and the electrostatic latent image recorded on the photoconductive surface 13 is developed by bringing the brush of developer mix into contact therewith. Toner is replenished in the developer housing through toner dispenser 25 as will be discussed in further detail hereinafter.

Sheets 16 of the final support material are supported in a stack arrangement on an elevating stack support tray 20. With the stack at its elevated position a sheet separator 21 feeds individual sheets therefrom to the registration system 22. The sheet is then forwarded to the transfer station 23 in the proper registration with the image on the drum. The developed image on the photoconductive surface 13 is brought into contact with the sheet 16 of the final support material within the transfer station 23 and the toner image is transfered from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 27.

Although a preponderance of the toner powder is transferred to the final support material 16, invariably some residual toner remains on the photoconductive surface 13 after the transfer of the toner image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, the use of a blade.

Reference is now made to FIGS. 2–5 where the toner dispensing system and toner cartridge are described in greater detail.

The toner dispenser comprises two side walls 37, 38 which are connected at their end by two end walls, not shown. The top of the toner dispenser 25 is provided with a rectangular opening 39 which is normally covered by a sealing lid (not shown) through which new toner material may be added directly to the toner dispenser to replenish the supply in the developer housing. The bottom portions of the side walls 37, 38 and the end walls form an elongated opening 40 in the bottom of the dispenser. The inclined surface of the side walls 37, 38 function to direct particulate material supported within the container downwardly toward the opening 40. At the bottom of the toner dispenser is a rotatable dispensing roll 43 mounted on shaft 44 which is periodically rotated by means not shown to dispensing toner. The primary function of the dispensing roll is to deliver a substantially uniform and even quantity of particulate material across the elongated toner dispensing opening. Typically the dispensing roll 43 is made of a compliant foam material which is depressed or mechanically biased by each of the lobes 45, 46, 47, 48 in the cavity at the bottom of the dispenser in which the dispensing roll is mounted. With this arrangement of lobes against the foam roll sufficient pressure is maintained between the roll and the interior of the container to prevent unwanted toner from passing therebetween. In effect the resiliently deformable roll functions to form a movable seal capable of retaining toner material within the container.

With continued reference to FIGS. 2–5, the toner cartridge 36 will be described in greater detail. The cartridge comprises three individual pieces, the base plate 51, toner hopper 52, cartridge cover 53. In addition, if desired the bottom or dispensing surface of the cartridge is desired may be covered with a flexible stripable sealing tape to seal off the aperture, as will be discussed hereinafter, in the base plate. The base plate 51 comprises a bottom plate 56 having a plurality of rectangular shaped apertures 57 therein. At each end of the rectangular shaped apertures are a plurality of hooks 58 arranged in two parallel rows on opposite sides of the apertures in the base plate. At the front end of and on the exterior of the base plate is hook 59 which is adapted to lock under the lip 41 of a toner dispenser opening when the toner cartridge is placed in the opening. The base plate like the toner hopper 52 and the cover 53 can be molded from any suitable plastic material. Typically they can be fabricated by injection molding polystyrene. The base plate 51 also includes two sets of parallel sides 62, 63 and 64, 65 the tops of which are adapted to form a sliding seal with the underside of the top side rails 67 of the toner hopper 52. At the end of the base plate, side 65 opposite the base plate end hook 59, an indent 74 is formed in the toner cartridge cover 53 to provide a space for the hook 68 to slide under the machine toner dispenser. In the end wall is a narrow vertical slit through which a support member for the toner hopper end hook 68.

The toner hopper 52 comprises a plurality of bins 69 arranged at longitudinal length. Each of the bins is formed by four inclined side portions 70 which define a chute terminating in an aperture in the bottom of the toner hopper thereby providing a plurality of apertures 71 along the longitudinal length of the bottom of the toner hopper. The side portions are inclined to the plane of base plate to define a chute to more readily empty the hopper. Typically the side portions are inclined at an angle of from about 35° to 55° to the plane of the base plate with an angle of about 45° being preferred in insuring toner flow from the hopper. At the bottom of the apertures 71 in the toner hopper are a pair of parallel tracks 60 on opposite sides of the plurality of apertures which are positioned so that when assembled they are in sliding engagement with the plurality of hooks 58 arranged in parallel rows on opposite sides of said apertures in the base plate. At the end of the toner hopper opposite the end of the base plate having the base plate end hook is a further hook adapted to lock under the lip of the toner dispenser opening when placed in it. On top of the toner hopper is a system of rails comprising side rails 67 as well as similar rails 73 around the ends and cut out portion and indented portion 74 which are arranged to position the cartridge cover 53 on the top of the toner hopper 52, the cartridge cover having the same bottom cross section as the top of the toner hopper.

The three elements, the base plate 51, toner hopper 52, and cartridge cover 53 are assembled one on top of the other. The toner hopper is assembled by snapping the parallel side roller of the hopper under the grip of the parallel array of hooks in the base plate so that the toner hopper is longitudinally movable relative to the base plate. In addition the top of the base plate sides 62, 63 are slidably movable relative to the bottom of the top side support in the toner hopper. The cartridge cover 53 is securely fastened to the top of the toner hopper in any suitable manner. Preferably it is faster so as to avoid leaks and this may be readily accomplished by ultrosonically welding for example, the cover to the top of the hopper. The spacing of the apertures in the base plate and the spacing of the apertures in the toner hopper are arranged such that they are in open communication with each other when in open or dispensing position. When in the closed position such as an initial assembly, the portions often base plate between the apertures in the base plate are in sealing engagement with the apertures in the toner hopper thereby prohibiting passage of toner from the hopper through the hopper aperture, through the base plate aperture into the toner dispenser. Once assembled, the toner cartridge 36 may be filled with loose toner typically through an opening 75 in the top or one of the sides of the toner cover which has either been molded or cut into the cover. Typically the cartridge is filled with toner from a filling tube. To insure that any toner spilled during the filling procedure does not penetrate any of the tiny openings between the base plate and the hopper, the bottom of the cartridge may be sealed with a strip of flexible stripable tape 76. Once filled with toner while the hopper and the base plate are in the closed position, the filling hole is closed in any suitable manner such as a rubber plug cup or the like.

Figure 4:
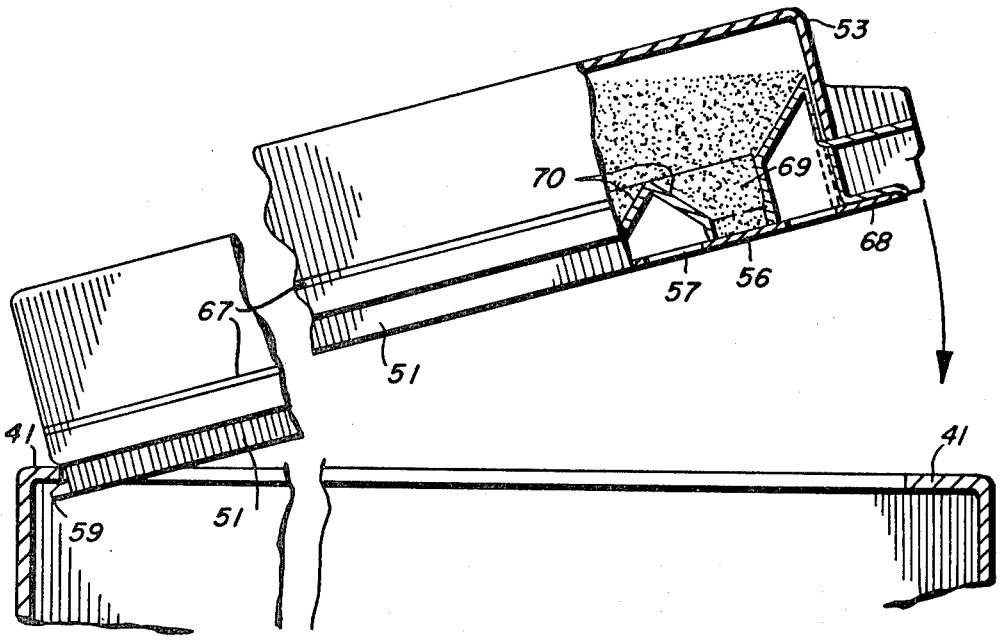
FIGS. 4 and 5 are side views (partially in cross section) of the toner cartridge of the present invention being placed in the toner dispenser to replenish toner.
Figure 5:
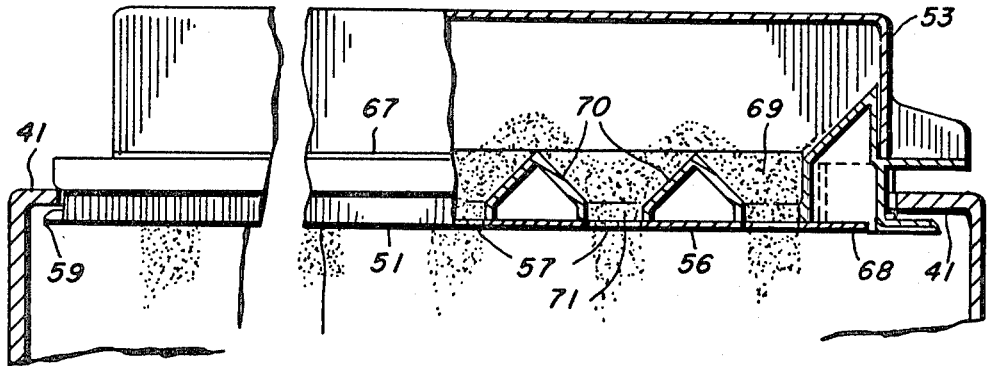

FIGS. 4 and 5 illustrated in detail the operation of the toner cartridge of the present invention. The front end of the cartridge with the base plate and hopper in the closed or sealed position is lowered into the toner dispenser opening. The cartridge is urged downwardly (FIG. 4) so that the base plate end hook slides under the lip of the toner dispenser. The rear end of the time cartridge is then dropped down with the toner dispenser opening. Once wholly within the opening the base plate is locked in position since its shape is the shape of the toner dispenser opening. The toner hopper may then be manually moved to the right (FIG. 5) relative to the base plate so that the toner hopper end hook locks under the opposite lip of the toner dispenser opening. At the same time, the apertures in the toner hopper become aligned with the apertures in the base plate in the toner dispenser position, and toner falls through from the hopper into the toner dispenser. The closed or sealed initial position of the vertical end hook support is shown in dashed line in FIG. 5 and the final locking position of the vertical end hook support and the hook are shown in solid line in FIG. 5. Once in the dispense or open position, the toner falls from the bins in the hopper through the hopper apertures, through the base plate aperture into the toner dispenser. It frequently helps to loosen the toner in the bins by gently manually tapping the cartridge cover. While the toner is passing from the cartridge to the dispenser the cartridge cannot be removed from the dispenser opening thereby minimizing the possibility of toner escaping from inside the cartridge and the hopper. When the toner cartridge has been depleted of toner, the toner hopper is moved to the left (FIG. 4) relative to the base plate with the hopper end lock being retracted from the lip of the toner dispenser and the hopper apertures once again being sealed by the base plate portions betwen adjacent base plate apertures so that if there is any residual toner in the hopper it is once again sealed within the hopper. The cartridge may now be removed from the toner dispenser and discarded.

The toner cartridge 36 of the present invention can be made to virtually any shape, configuration or size and still be inexpensive to manufacture and easy to use. It provides a very clean toner replenishing operation since toner cannot be removed until the cartridge is locked into the machine and once locked in the machine it cannot be removed until the cartridge is returned to the closed position. Finally it has the additional advantage of being disposable so it does not have to be returned to the toner supplier and cleaner for subsequent reuse. Altogether it is believed that such a device will substantially reduce machine dirt and thereby service calls for a trained technician.

While this invention has been described with reference to the structure disclosed herein, it is not confined to the details set forth in this application but is intended to cover modifications and changes as may become apparent to the artisan. For example, while the toner cartridge has been described as containing a number of rectangular bins from which to dispense the toner, it is contemplated that the bins may be circular or oval in cross section. It is intended that this and other modifications which would come to the mind of the artisan are to come within the scope of the appended claims.

I claim:

1. A toner cartridge for replenishing toner in a toner dispenser comprising a base plate and a toner hopper positioned on top of and slidably engaged with said base plate, said base plate having at least one aperture in the bottom through which toner may pass and having a hook at a front end adapted to lock under the lip of a toner dispenser opening when said toner cartridge is placed therein, said toner hopper having at least one aperture in the bottom through which toner may pass and having a hook at the end opposite the front end of the base plate adapted to lock under the lip of opposite the toner dispenser opening of the base plate, said at least one aperture in said base plate and said toner hopper not being in communicating alignment when in a closed position and, said base plate providing a seal under said at least one opening in said closed position;

means to slidably move said toner hopper relative to said base plate to an opened positioned wherein said hook an said toner hopper locks under the opposite lip of the toner dispenser opening and said at least one aperture in said toner hopper is in communicating alignment so that toner may pass from said toner hopper through said base plate to the toner dispenser whereby said toner cartridge dispenses toner only when in the locked position and said toner cartridge is removable from said toner dispenser only when said toner hopper and said base plate are in the closed position.

2. The toner cartridge of claim 1 wherein said means to slidably move said toner hopper relative to said base plate comprises at least one track on said hopper in slidable engagement with at least one hook in said base plate.

3. The toner cartridge of claim 1 wherein said toner cartridge is rectangular in horizontal cross section and both said base plate and said toner hopper are rectangular.

4. The toner cartridge of claim 3 wherein said at least one aperture in both said base plate and said toner hopper each comprises a plurality of apertures and wherein each of said apertures in said toner hopper and each of said apertures in said base plate are positioned such that they are in communicating alignment when in the opened position and that portions of said base plate between said apertures in said base plate are in sealing engagement with said plurality of apertures in said toner hopper when said base plate and said hopper are in the closed position.

5. The toner cartridge of claim 4 wherein said means to slidably move said toner hopper relative to said base plate comprises a pair of parallel tracks on opposite sides of the plurality of apertures on said hopper in sliding engagement with a plurality of hooks arranged in parallel rows on opposite sides of said apertures in said base plate.

6. The toner cartridge of claim 5 wherein the top of said toner hopper is open and said toner cartridge has a cover member sealingly engaged with the top of said toner hopper.

7. The toner cartridge of claim 5 including a strip of flexible stripable tape in sealing engagement with the plurality of apertures of said base plate.

8. The toner cartridge of claim 4 wherein said toner hopper comprises a plurality of bins each with a plurality of inclined side portions defining a chute which terminates in the plurality of apertures in said toner hopper.

9. The toner cartridge of claim 8 wherein there are four equally shaped side portions each inclined at an angle of from about 35° to about 55° to the plane of the base plate.

10. The toner cartridge of claim 9 wherein said side portions are inclined at an angle of about 45° to the plane of the base plate.

11. The toner cartridge of claim 4 wherein said toner hopper has a sealable hole in one end for filling said cartridge with toner.

* * * * *